United States Patent [19]

Brotherton et al.

[11] Patent Number: 4,812,621

[45] Date of Patent: Mar. 14, 1989

[54] ELECTRICALLY HEATED DISH DRYING RACK

[76] Inventors: Tania Brotherton, c/o George Spector, 233 Broadway, Rm. 3815; George Spector, 233 Broadway, Rm. 3815, both New York, N.Y. 10007

[21] Appl. No.: 113,496

[22] Filed: Oct. 28, 1987

[51] Int. Cl.[4] ..... F26B 9/10; H05B 1/00; F24H 3/04

[52] U.S. Cl. ..... 219/366; 34/237; 34/239; 34/243 R; 211/41; 219/367; 219/368; 219/370; 219/400; 219/521

[58] Field of Search ..... 219/366–370, 219/385, 400, 521, 214; 34/243 R, 237, 239; 211/41

[56] References Cited

U.S. PATENT DOCUMENTS

| | | | |
|---|---|---|---|
| 1,973,347 | 9/1934 | Kelly | 34/237 |
| 2,197,178 | 4/1940 | Gates | 219/366 |
| 2,516,378 | 7/1950 | Fletcher | 219/366 X |
| 2,884,708 | 5/1959 | Levitt | 219/370 X |
| 2,897,973 | 8/1959 | Sizemore | 34/237 X |
| 3,007,256 | 11/1961 | Rouy | 219/370 X |
| 4,258,248 | 3/1981 | Campo | 219/370 X |
| 4,677,764 | 7/1987 | Cerney | 34/239 X |

FOREIGN PATENT DOCUMENTS

| | | | |
|---|---|---|---|
| 1951195 | 4/1971 | Fed. Rep. of Germany | 34/243 R |
| 1964289 | 6/1971 | Fed. Rep. of Germany | 34/243 R |
| 2808239 | 8/1979 | Fed. Rep. of Germany | 34/243 R |
| 2108253 | 5/1983 | United Kingdom | 219/366 |
| 2143012 | 1/1985 | United Kingdom | 34/243 R |

*Primary Examiner*—Anthony Bartis

[57] ABSTRACT

A portable dryer device is provided which consists of an open top housing for receiving a dish rack therein for drying the dishes. The housing contains an electric heating element and motor driving a fan blade to force hot air past a tilted slotted elevated plate holding the dish rack, wherein manually adjustable hot air deflectors are mounted in the slots to vary the angle of travel of the hot air for more effective drying, while a drain spout in the housing allows excess water to exit therefrom.

3 Claims, 1 Drawing Sheet

ELECTRICALLY HEATED DISH DRYING RACK

BACKGROUND OF THE INVENTION

The instant invention relates generally to heating apparatuses and more specifically it relates to a dish dryer device.

Numerous heating apparatuses have been provided in prior art that are adapted to heat either dishes or towels with an electrical heater unit. For example, U.S. Pat. Nos. 3,351,741; 3,538,309 and 4,117,309 all are illustrative of such prior art. While these units may be suitable for the particular purpose to which they address, they would not be as suitable for the purposes of the present invention as heretofore described.

SUMMARY OF THE INVENTION

A primary object of the present invention is to provide a dish dryer device that will overcome the shortcomings of the prior art devices.

Another object is to provide a dish dryer device embodying a novel way for maintaining the dishes arranged therein in a heat drying condition.

An additional object is to provide a dish dryer device that is portable so as to be placed onto a counter top adjacent a sink in which residue water can drain back into the sink when the dishes are being dried within the device.

A further object is to provide a dish dryer device that is simple and easy to use.

A still further object is to provide a dish dryer device that is economical in cost to manufacture.

Further objects of the invention will appear as the description proceeds.

The above objectives are achieved by providing a portable dish rack which is supported over a slotted elevated plate which directs heat from a heating element to the rack with a drain spout at a lower end of the housing.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
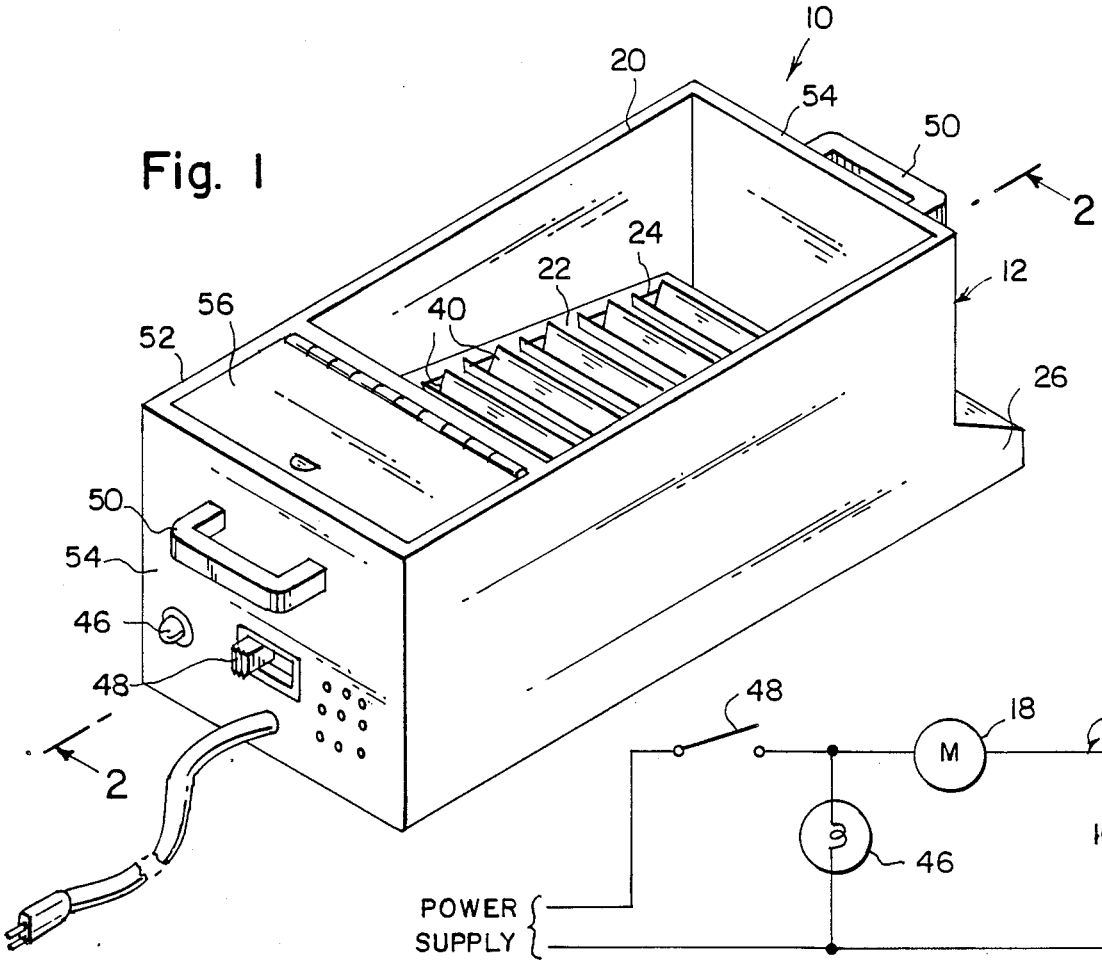
FIG. 1 is a perspective view of the invention.
Figure 2:
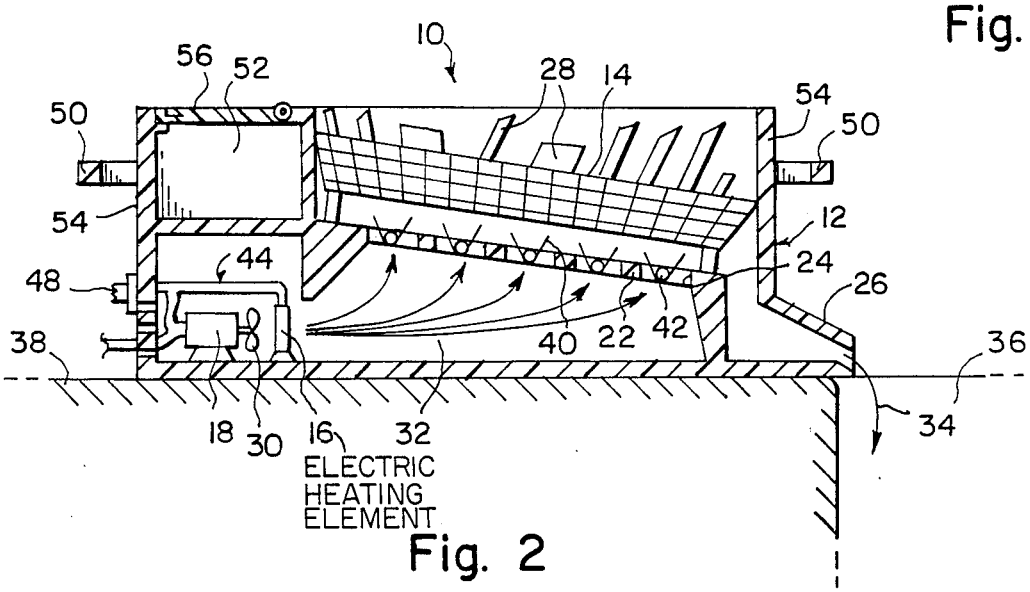
FIG. 2 is a cross sectional view taken along line 2—2 in FIG. 1 showing the motor, heater and internal structure therein.

Turning now descriptively to the drawings, in which similar reference characters denote similar elements throughout the several views, FIGS. 1 and 2 illustrate a dish dryer device 10 that consists of a rectangular housing 12, a removable rack 14, an electric heating element 16 and an electric motor 18. The housing 12 has an open top 20 and includes a tilted elevated plate 22 that has a plurality of slots 24 therein with a drain spout 26 adjacent lower end of the elevated plate 22. A plurality of dishes 28 can be conveniently stacked in the rack 14 which is placed upon the elevated plate 22. The electric heating element 16 is positioned in the housing 12 below and to high end of the elevated plate 22. The electric motor 18 with a fan blade 30 is positioned in the housing 12 in alignment behind the heating element 16 so as to force air 32 and to take heat from the heating element 16, so as to travel up past the elevated plate 22 drying the dishes 28 within the rack 14, while the drain spout 26 allows excess water 34 to exit therefrom into a sink 36 with a counter top 38.

A plurality of hot air deflectors 40 are provided, in which each is pivotly mounted at 42 within each of the slots 24 in the elevated plate 22. The angle of the deflectors 40 can be manually changed to vary the angle travel of the hot air 32 up to the dishes 28 within the rack 14.

Figure 3:
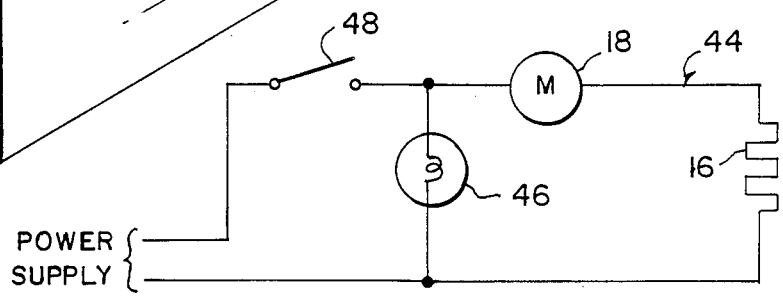
FIG. 3 is a schematic circuit diagram of the control circuitry.

As best seen in FIG. 3, the dish dryer device 10 further contains a control circuitry 44 that includes an on-off light 46 and an on-off switch 48 electrically connected to the electric heating element 16 and the electric motor 18.

The dish dryer device 10 also contains a pair of handles 50 and a compartment 52. Each of the handles 50 is affixed to an opposite short side 54 of the housing 12 so that the housing 12 can become portable by being carried from place to place. The compartment 52 has a hinged door 56 formed in the top portion of the housing 12, above the motor 18 and the heating element 16. The compartment 52 is for storing various articles (not shown), such as can be used in conjunction with either washing or drying the dishes 28.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A dish dryer device which comprises:

(a) a rectangular housing having a bottom, sides and an open top and including a tilted elevated plate in said housing above the bottom thereof having a plurality of slots therein, said housing having a drain spout adjacent and below the lower end of the elevated plate;

(b) a removable rack in which a plurality of dishes can be conveniently stacked, said rack placed upon the elevated plate through said top of said housing;

(c) an electric heating element in said housing below and to high end of the elevated plate and (d) an electric motor with a fan blade in communication with an air inlet in said housing in alignment behind said heating element so as to force air past said heating element to take heat from said heating element, through the slots of the elevated plate drying the dishes within said rack while the drain spout allows excess water dripping from the dishes stacked on said rack and falling through said slots to exit said housing, further comprising a plurality of hot air deflectors, each of which is pivotly mounted within a separate one of the slots in the elevated plate so that the angle of said deflectors can be manually changed to vary the angle of travel of the heated air up to the dishes within said rack.

2. A dish dryer as in claim 1, further comprising a control circuitry that includes an on-off light add an on-off switch electrically connected to said electric heating element and said electric motor.

3. A dish dryer device as recited in claim 1, wherein said housing is rectangular and has a pair of long sides and a pair of short sides:

(a) a pair of handles, each of which is affixed to a different one of the short sides of said housing so that said housing can become portable by being carried from place to place; and (b) a compartment having a hinged door formed in top portion of said housing above said motor and said heating element, said compartment providing for storage of various articles, such as can be used in conjunction with either washing or drying the dishes.

* * * * *